US010399815B2

(12) United States Patent
Ginsberg et al.

(10) Patent No.: US 10,399,815 B2
(45) Date of Patent: Sep. 3, 2019

(54) CAR SEPARATION CONTROL IN MULTI-CAR ELEVATOR SYSTEM

(71) Applicant: Otis Elevator Company, Farmington, CT (US)

(72) Inventors: David Ginsberg, Granby, CT (US); Arthur Hsu, South Glastonbury, CT (US); Jose Miguel Pasini, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 603 days.

(21) Appl. No.: 15/175,208

(22) Filed: Jun. 7, 2016

(65) Prior Publication Data

US 2017/0349397 A1 Dec. 7, 2017

(51) Int. Cl.

| | |
|---|---|
| ***B66B 1/28*** | (2006.01) |
| ***B66B 1/34*** | (2006.01) |
| ***B66B 9/00*** | (2006.01) |
| ***B66B 9/02*** | (2006.01) |

(52) U.S. Cl.

CPC ..... *B66B 1/3407* (2013.01); *B66B 1/28* (2013.01); *B66B 9/00* (2013.01); *B66B 9/003* (2013.01); *B66B 9/02* (2013.01); *B66B 2009/006* (2013.01); *B66B 2201/307* (2013.01)

(58) Field of Classification Search

CPC ..... B66B 1/3407; B66B 1/28; B66B 9/00; B66B 9/003; B66B 9/02; B66B 2201/307; B66B 2201/006

USPC ..... 187/247, 249, 288, 293, 391, 393, 295

See application file for complete search history.

(56) References Cited

U.S. PATENT DOCUMENTS

| | | | | |
|---|---|---|---|---|
| 4,751,984 | A | 6/1988 | Williams et al. | |
| 5,526,901 | A | 6/1996 | Salmon | |
| 5,663,538 | A * | 9/1997 | Sakita | B66B 1/2466 187/249 |

(Continued)

FOREIGN PATENT DOCUMENTS

GB 2245386 A 1/1992

OTHER PUBLICATIONS

Markon, Sandor et al., "Direct Control of Multi-Car Elevators with Real-Time GA", INES 2007, 11th International Conference on Intelligent Engineering Systems, Jun. 29-Jul. 1, 2007, Budapest, Hungary, 4 pages.

(Continued)

*Primary Examiner* — Anthony J Salata
(74) *Attorney, Agent, or Firm* — Cantor Colburn LLP

(57) ABSTRACT

A method for controlling car separation in a multi-car elevator system, the method including: initiating, by a controller, a change in a profile of a target elevator car; determining that N elevators cars are affected by the change in the profile of the target elevator car, wherein elevator car N is an elevator car farthest from the target elevator car; calculating for each of the N elevator cars an updated profile; for each of the N elevator cars, beginning with the Nth elevator car and ending with the target elevator car, performing: determining if the updated profile for the elevator car will provide separation between the elevator car and a neighboring elevator car; and when the updated profile for the elevator car will provide separation between the elevator car and the neighboring elevator car, executing an elevator car profile update process for the elevator car.

18 Claims, 5 Drawing Sheets

(56) References Cited

U.S. PATENT DOCUMENTS

| | | | | |
|---|---|---|---|---|
| 5,877,462 | A | 3/1999 | Chenais | |
| 6,364,065 | B1 * | 4/2002 | Hikita | B66B 1/2466 187/382 |
| 6,955,245 | B2 * | 10/2005 | Dunser | B66B 1/2466 187/249 |
| 7,032,716 | B2 | 4/2006 | Meyle et al. | |
| 7,537,089 | B2 * | 5/2009 | Duenser | B66B 1/2466 187/247 |
| 7,621,376 | B2 * | 11/2009 | Duenser | B66B 9/00 187/247 |
| 7,819,228 | B2 | 10/2010 | Terry et al. | |
| 8,136,635 | B2 | 3/2012 | Christy et al. | |
| 8,297,409 | B2 | 10/2012 | Hsu et al. | |
| 8,356,697 | B2 | 1/2013 | Kriss et al. | |
| 8,424,650 | B2 | 4/2013 | Brand et al. | |
| 8,434,599 | B2 | 5/2013 | Wang et al. | |
| 8,739,936 | B2 | 6/2014 | Kostka et al. | |
| 9,010,499 | B2 | 4/2015 | McCarthy et al. | |
| 10,035,684 | B2 * | 7/2018 | Roberts | B66B 1/2491 |
| 10,081,513 | B2 * | 9/2018 | Hsu | B66B 1/30 |
| 2005/0082121 | A1 * | 4/2005 | Deplazes | B66B 5/0031 187/313 |
| 2013/0299282 | A1 | 11/2013 | Kugiya et al. | |
| 2017/0349397 | A1 * | 12/2017 | Ginsberg | B66B 1/3407 |

OTHER PUBLICATIONS

Omar, O. et al., "Modelling a Multi-car Elevator System using Witness", International Journal of Innovation and Applied Studies, vol. 4, No. 1, Sep. 2013, pp. 20-27.

Valdivielso, Alex, "Multicar-Elevator Group Control Algorithm for Interference Prevention and Optimal Call Allocation", IEEE Transactions on Systems, Man, and Cbermetics, Part A Systems and Humans (vol. 41 Issue 2) pub. Sep. 27, 2010, IEEE abstract, 2 pages.

* cited by examiner

CAR SEPARATION CONTROL IN MULTI-CAR ELEVATOR SYSTEM

TECHNICAL FIELD

The subject matter disclosed herein relates generally to the field of elevators, and more particularly, to controlling elevator car separation in a multi-car elevator system.

BACKGROUND

Existing elevator systems may employ multiple cars traveling in the same hoistway or lane. Operating multiple cars in a hoistway with sufficient separation between them is a challenge with any multi-car system. Previous strategies have been developed for maintaining separation between two cars in a hoistway under the assumption that the parameters of the motion (velocity, acceleration, jerk) are constant and will not change.

BRIEF DESCRIPTION

According to one embodiment, a method for controlling car separation in a multi-car elevator system comprises initiating, by a controller, a change in a profile of a target elevator car; determining that N elevators cars are affected by the change in the profile of the target elevator car, wherein elevator car N is an elevator car farthest from the target elevator car; calculating for each of the N elevator cars an updated profile; for each of the N elevator cars, beginning with the Nth elevator car and ending with the target elevator car, performing: determining if the updated profile for the elevator car will provide separation between the elevator car and a neighboring elevator car; and when the updated profile for the elevator car will provide separation between the elevator car and the neighboring elevator car, executing an elevator car profile update process for the elevator car.

In addition to one or more of the features described above, or as an alternative, further embodiments may include wherein the elevator car profile update process comprises: sending, from the controller to a motion controller, a target and a commanded profile for an elevator car; receiving, at the motion controller, the target and the commanded profile, the motion controller determining an initial condition of the elevator car corresponding to a current condition of the elevator car; generating, by the motion controller, a new profile for the elevator car in response to the target, the commanded profile and the initial condition of the elevator car; and sending from the motion controller to the controller an acceptance message indicating acceptance by the motion controller of the target and the commanded profile.

In addition to one or more of the features described above, or as an alternative, further embodiments may include wherein the elevator car profile update process further comprises: sending, by the motion controller to the controller, the initial condition of the elevator car.

In addition to one or more of the features described above, or as an alternative, further embodiments may include wherein the elevator car profile update process further comprises: determining, by the controller, an updated profile for the elevator car in response to the initial condition of the elevator car and the commanded profile.

In addition to one or more of the features described above, or as an alternative, further embodiments may include wherein: the commanded profile includes a velocity limit, acceleration limit and jerk limit.

In addition to one or more of the features described above, or as an alternative, further embodiments may include wherein: the initial condition of the elevator car includes position, velocity and acceleration.

In addition to one or more of the features described above, or as an alternative, further embodiments may include wherein: the sending from the controller to the motion controller the target and the commanded profile for the elevator car includes sending a unique command identifier.

In addition to one or more of the features described above, or as an alternative, further embodiments may include wherein: the sending from the motion controller to the controller the acceptance message includes sending the unique command identifier.

According to another embodiment, an elevator system comprises: an elevator car; a system to impart force to the elevator car in a hoistway; a motion controller operable to command the system to impart force to the elevator car; and a controller in communication with the motion controller, the controller configured to execute operations comprising: initiating a change in a profile of a target elevator car; determining that N elevators cars are affected by the change in the profile of the target elevator car, wherein elevator car N is an elevator car farthest from the target elevator car; calculating for each of the N elevator cars an updated profile; for each of the N elevator cars, beginning with the Nth elevator car and ending with the target elevator car, performing: determining if the updated profile for the elevator car will provide separation between the elevator car and a neighboring elevator car; and when the updated profile for the elevator car will provide separation between the elevator car and the neighboring elevator car, executing an elevator car profile update process for the elevator car.

In addition to one or more of the features described above, or as an alternative, further embodiments may include wherein the operations further comprise: sending, from the controller to the motion controller, a target and a commanded profile for an elevator car; receiving, at the motion controller, the target and the commanded profile, the motion controller determining an initial condition of the elevator car corresponding to a current condition of the elevator car; generating, by the motion controller, a new profile for the elevator car in response to the target, the commanded profile and the initial condition of the elevator car; and sending from the motion controller to the controller an acceptance message indicating acceptance by the motion controller of the target and the commanded profile.

In addition to one or more of the features described above, or as an alternative, further embodiments may include wherein the operations further comprise: sending, by the motion controller to the controller, the initial condition of the elevator car.

In addition to one or more of the features described above, or as an alternative, further embodiments may wherein the operations further comprise: determining, by the controller, an updated profile for the elevator car in response to the initial condition of the elevator car and the commanded profile.

In addition to one or more of the features described above, or as an alternative, further embodiments may include wherein: the commanded profile includes a velocity limit, acceleration limit and jerk limit.

In addition to one or more of the features described above, or as an alternative, further embodiments may include wherein: the initial condition of the elevator car includes position, velocity and acceleration.

In addition to one or more of the features described above, or as an alternative, further embodiments may include wherein: the sending, from the controller to the motion controller, the target and the commanded profile for the elevator car includes sending a unique command identifier.

In addition to one or more of the features described above, or as an alternative, further embodiments may include, wherein: the sending from the motion controller to the controller the acceptance message includes sending the unique command identifier.

In addition to one or more of the features described above, or as an alternative, further embodiments may include, wherein: the system to impart force to the elevator car is a ropeless system.

In addition to one or more of the features described above, or as an alternative, further embodiments may include wherein: the system to impart force to the elevator car is a roped system.

Technical effects of embodiments of the disclosure include the ability to dynamically control elevator car separation in a multi-car elevator system.

These and other advantages and features will become more apparent from the following description taken in conjunction with the drawings.

BRIEF DESCRIPTION OF THE DRAWINGS

The foregoing and other features, and advantages are apparent from the following detailed description taken in conjunction with the accompanying drawings in which.

DETAILED DESCRIPTION

Figure 1:
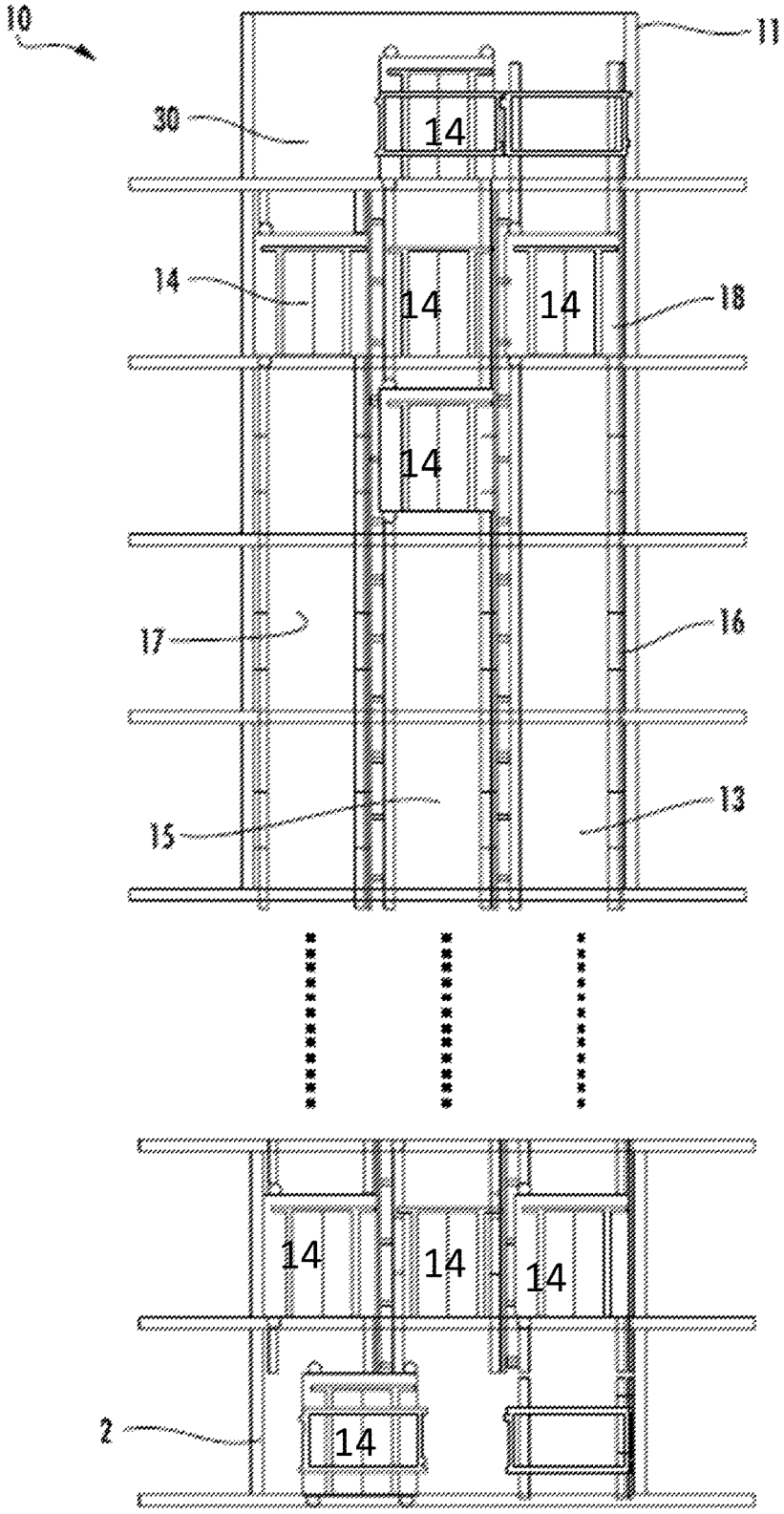
FIG. 1 depicts a multi-car, self-propelled elevator system in an embodiment.

Embodiments relate to controlling elevator car separation in a multi-car elevator system. The multi-car elevator system may be ropeless, roped, or other configuration. FIG. 1 depicts a multi-car, self-propelled (e.g., ropeless) elevator system 10 in an exemplary embodiment. Elevator system 10 includes a hoistway 11 having a plurality of lanes 13, 15 and 17. While three lanes are shown in FIG. 1, it is understood that embodiments may be used with multi-car, self-propelled elevator systems have any number of lanes. In each lane 13, 15, 17, elevator cars 14 travel in one direction, i.e., up or down. For example, in FIG. 1 elevator cars 14 in lanes 13 and 15 travel up and elevator cars 14 in lane 17 travel down. In other embodiments, the elevator cars 14 may travel both up and down in each lane 13, 15 and 17. One or more elevator cars 14 may travel in a single lane 13, 15, and 17.

Above the top floor is an upper transfer station 30 to impart horizontal motion to the elevator cars 14 to move the elevator cars 14 between lanes 13, 15 and 17. It is understood that the upper transfer station 30 may be located at the top floor, rather than above the top floor. Below the first floor is a lower transfer station 32 to impart horizontal motion to the elevator cars 14 to move the elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and the lower transfer station 32.

Elevator cars 14 are propelled using a linear propulsion system having a primary, fixed portion 16 and a secondary, moving portion 18. The primary portion 16 includes windings or coils mounted at one or both sides of the lanes 13, 15 and 17. The secondary portion 18 includes permanent magnets mounted to one or both sides of the elevator cars 14. The primary portion 16 is supplied with drive signals to control movement of the elevator cars 14 in their respective lanes.

Figure 2:
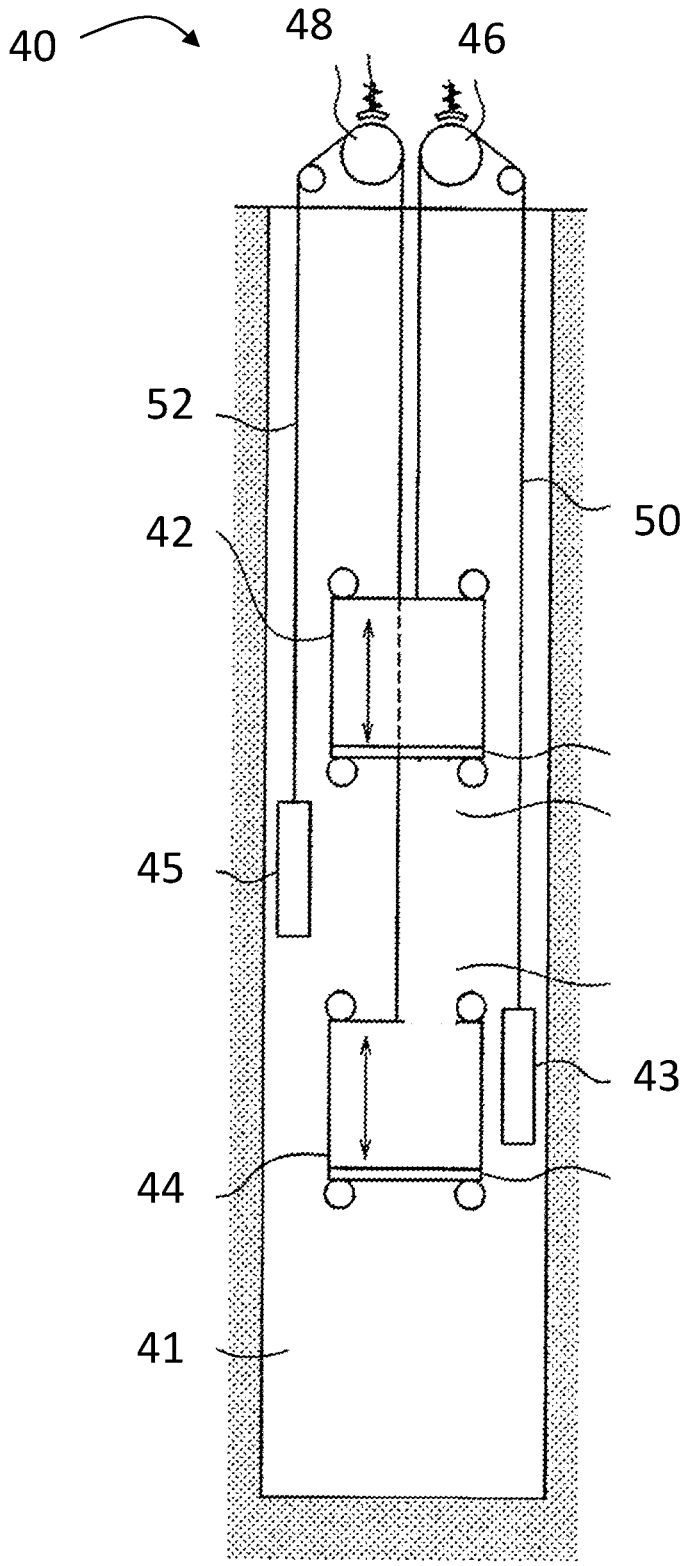
FIG. 2 depicts a multi-car, roped elevator system in an embodiment.

FIG. 2 depicts a multi-car, roped elevator system 40 in an exemplary embodiment. Elevator system 40 includes a hoistway 41 having a single lane. Elevator system 40 includes a first elevator car (an upper elevator car) 42, a first counterweight 43 that corresponds to the first elevator car 42, a second elevator car (a lower elevator car) 44, and a second counterweight 45 that corresponds to the second elevator car 44. The first elevator car 42 is disposed above the second elevator car 44.

A first machine 46 that raises and lowers the first elevator car 42 and the first counterweight 43 and a second machine 48 that raises and lowers the second elevator car 44 and the second counterweight 45 are installed in an upper portion of the hoistway 41. The first and second elevator cars 42 and 44 are raised and lowered inside the hoistway 41 independently from each other by the machines 46 and 48. A first suspending member 50 is wound around a driving sheave of the first machine 46. The first elevator car 42 and the first counterweight 43 are suspended inside the hoistway 41 by the first suspending member 50. A second suspending member 52 is wound around the driving sheave of the second machine 48. The second elevator car 44 and the second counterweight 45 are suspended inside the hoistway 41 by the second suspending member 52.

Figure 3:
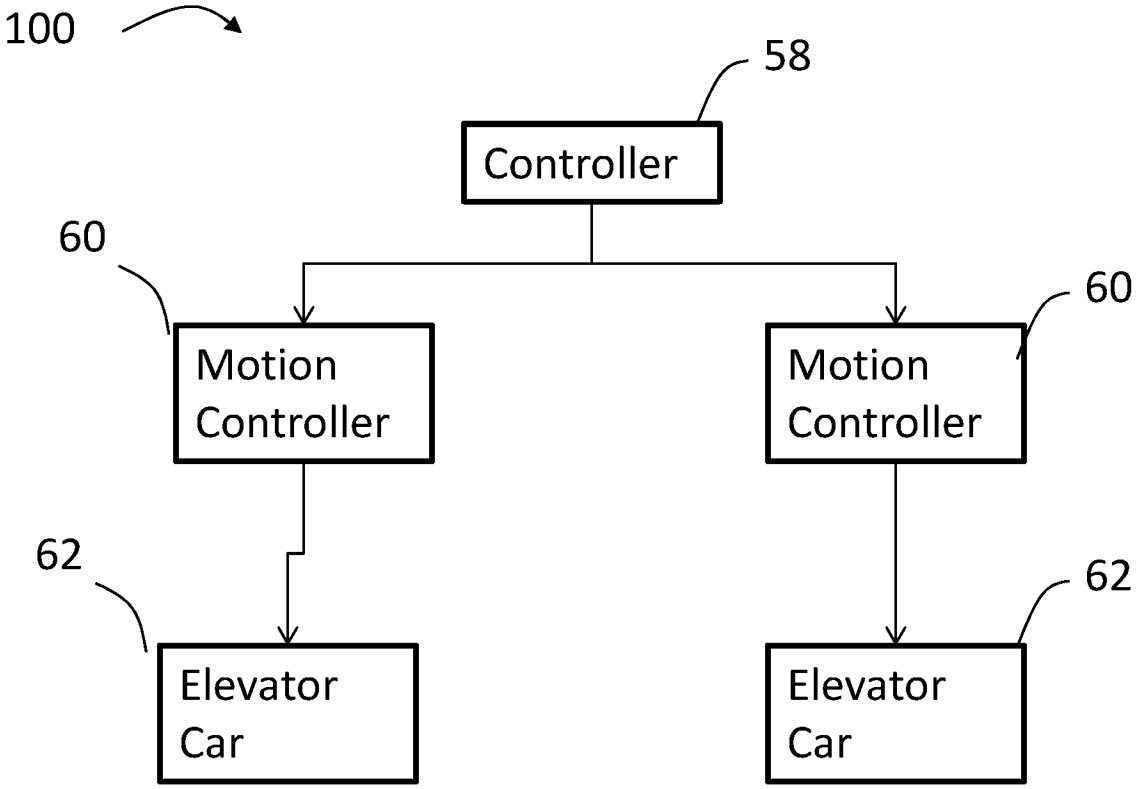
FIG. 3 depicts a control system of the elevator system in an embodiment.

In operation, elevator cars are controlled so as to dynamically adjust motion profiles of the cars so as to maintain suitable separation between elevator cars. FIG. 3 depicts a control system 100 of an elevator system in an embodiment. The control system 100 may be used with the ropeless elevator system 10 of FIG. 1 or the roped elevator system 40 of FIG. 2. A controller 58 may serve as a lane supervisor or hoistway supervisor, responsible for controlling the elevator cars traveling in a common path. The controller 58 communicates with motion controllers 60, which in turn control elevator cars 62. In the embodiment of FIG. 1, a motion controller 60 may control an elevator car 14 or a section of the linear propulsion system. In the embodiment of FIG. 2, a motion controller 60 may control machine 46 or 48.

The controller 58 can command movement of the elevator car(s) 62 upward or downward in the hoistway, e.g., to a different floor of a building, and the motion controllers 60 implement lower-level (i.e., machine level) control to realize the commanded movement. The one or more motion controllers 60 convert commands from the controller 58 into commands to drive the primary portion 16 in FIG. 1 or the machines 46/48 of FIG. 2.

Each motion controller 60 may be implemented using a microprocessor executing a computer program stored on a storage medium to perform the operations described herein. Alternatively, one or more of the motion controllers 60 may be implemented in hardware (e.g., ASIC, FPGA) or in a combination of hardware/software. Similarly, the controller 58 may be implemented using a microprocessor executing a computer program stored on a storage medium to perform the operations described herein. Alternatively, the controller 58 may be implemented in hardware (e.g., ASIC, FPGA) or in a combination of hardware/software.

In operation, the controller 58 communicates with one or more motion controllers 60 to control the elevator cars 62. The control of the motion profile of the elevator cars may be performed dynamically (e.g., in the middle of elevator car runs). Dynamically controlling elevator car profiles may be used to maintain car separation, but also improve user perceived ride conditions such as wait times, travel times, etc.

Figure 4:
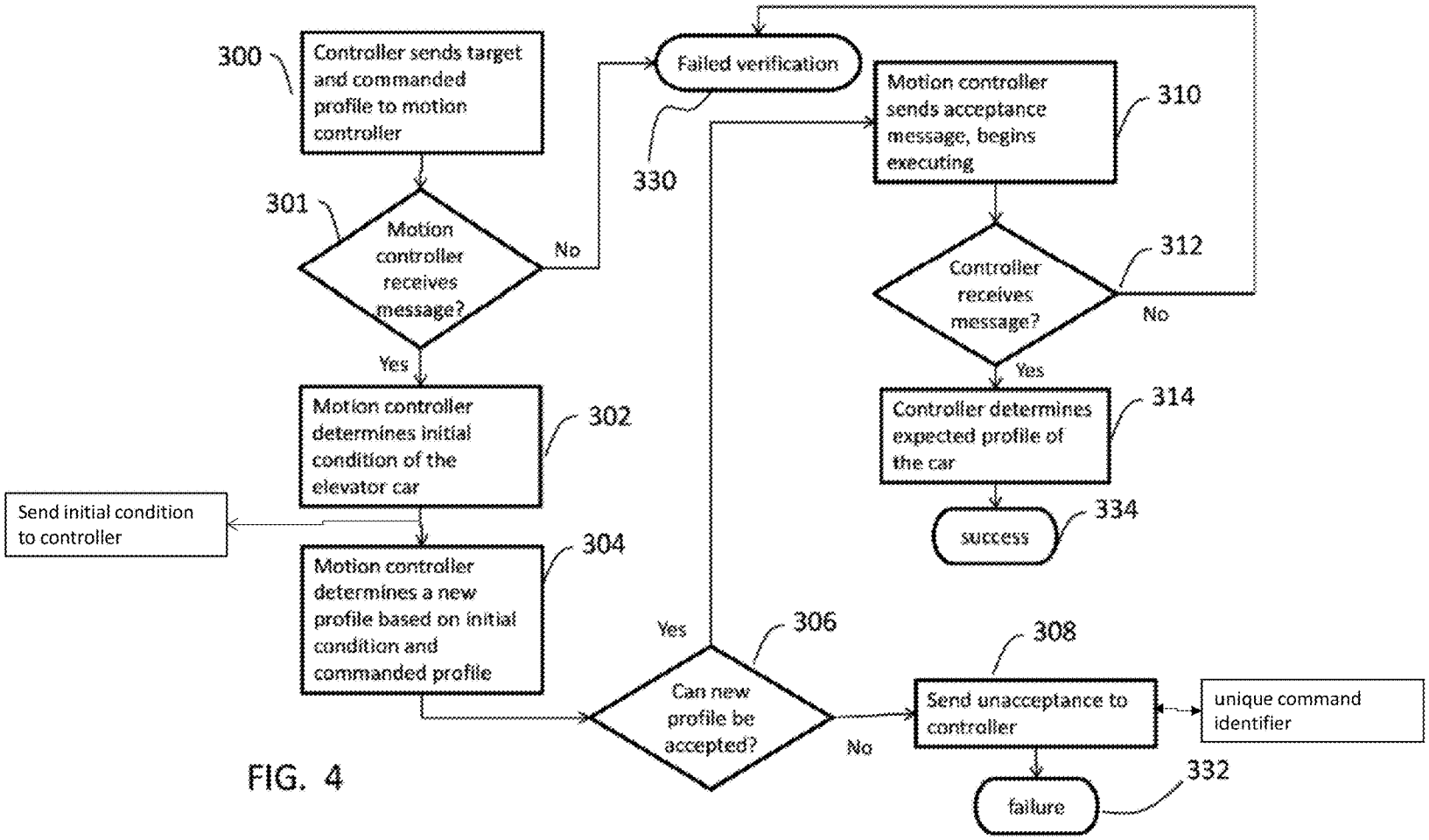
FIG. 4 depicts a process for dynamically controlling a profile of an elevator car in an embodiment.

FIG. 4 is flowchart of a process for dynamically controlling an elevator car profile in an embodiment. The process may occur at any time controller 58 needs to adjust a profile of one or more elevator cars 62, and need not be limited to the beginning or end of a run of the elevator car 62. The profile, or motion profile, identifies operating conditions, such as a velocity/velocity limit, acceleration/acceleration limit and/or jerk limit of an elevator car 62. An updated profile for the elevator car 62 may be sent by the controller 58 for various control processes, such as next committable floor, separation assurance between elevator cars 62 for normal stopping modes and urgent stopping modes, etc.

The process begins at 300, where the controller 58 sends a target and a commanded profile for an elevator car 62 to a motion controller 60. The target may be a floor (e.g., floor 12) or position (e.g., 47.2 meters) for the elevator car 62. The commanded profile may include profile settings such as a velocity limit, an acceleration limit and a jerk limit. The target and commanded profile may also be accompanied by a unique command identifier. The unique command identifier has a one-to-one correspondence with the target and the commanded profile and is used to identify the target and commanded profile by both the controller 58 and the motion controller 60.

At 301, a determination is made if the motion controller 60 received the message (e.g., target and commanded profile) from the controller 58. This may occur by the motion controller 60 sending an acknowledgement message to controller 58 along with the unique command identifier. If the motion controller 60 does not receive the message, flow proceeds to 330 where a failure message is generated.

If at 301 the message from the controller 58 is received at the motion controller 60, flow proceeds to 302 where, upon receiving the commanded profile, the motion controller 60 determines an initial condition of the elevator car 62 corresponding to a current condition of the elevator car 62. The initial condition may include current position, velocity and acceleration of the elevator car 62. The initial condition may be determined based on an existing profile for the elevator car 62, or measured using sensors. At 304, the motion controller 60 determines a new profile for the elevator car 62 in response to the target, the commanded profile and the initial condition of the elevator car 62. The new profile includes the target along with values for velocity, acceleration and jerk. In computing the new profile, the motion controller 60 may factor in changes in the initial condition due to processing delays. For example, the position, velocity and acceleration of the elevator car 62 may change in the time period from first determining the initial condition to computing the new profile At 306, the motion controller 60 determines if the commanded profile can be accepted. There may be situations where the motion controller 60 determines that due to some circumstances (e.g., undue delay at a stop, oversized load on elevator car, etc.) that the commanded profile cannot be achieved. If so, flow proceeds to 308 where the motion controller 60 sends an unacceptance message to the controller 58, along with the unique command identifier. The process terminates at 332 with a failure.

If at 306, the motion controller 60 can accept the commanded profile and target, flow proceeds to 310 where the motion controller 60 sends an acceptance message to the controller 58 along with the unique command identifier. This indicates to the controller 58 that the target and the commanded profile have been accepted by the motion controller 60. The motion control 60 begins executing the commanded profile. At 312, the controller 58 determines if the acceptance message has been received from the motion controller 60. If not, the process ends at 330. If so, flow proceeds to 314 where the controller 58 determines an expected profile on the elevator car 62 and the process ends at 334 as a successful update of the profile of the elevator car 62.

Figure 5:
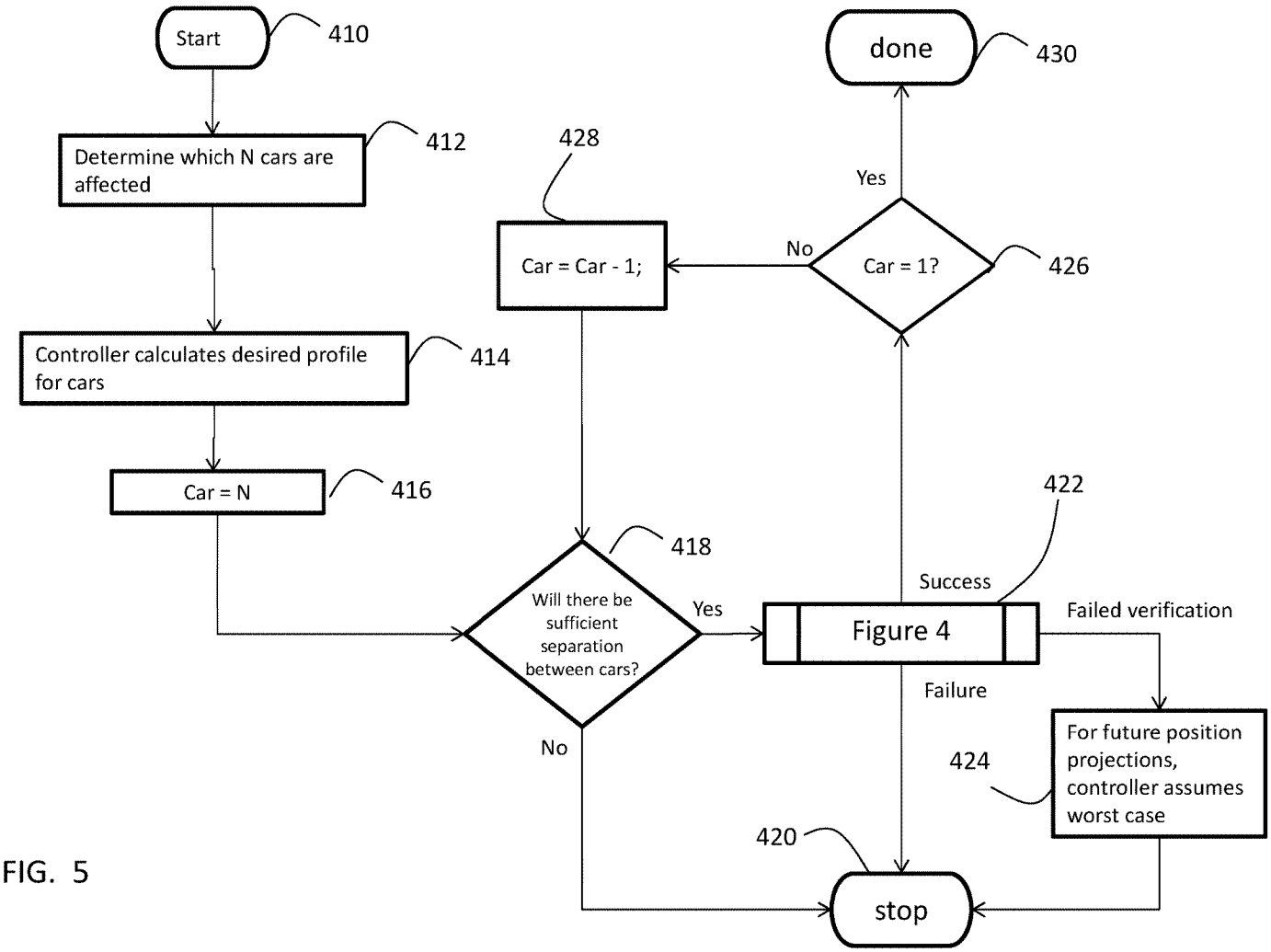
FIG. 5 depicts a process for dynamically controlling elevator car separation in an embodiment.

FIG. 5 depicts a process for dynamically controlling elevator car separation in an embodiment. The process may occur at any time controller 58 needs to adjust a profile of one or more elevator cars 62. The controller 58 begins the process at 410 when it is desirable to modify a profile of a target elevator car 62. At 412, the controller 58 determines the number of elevator cars, N (including the target elevator car), that will be affected by the change in profile to the target elevator car. For example, if three elevator cars are traveling upwards in a hoistway and the controller 58 needs to slow the uppermost car, then all 3 elevator cars may be affected by this profile change. At 412, the controller 58 may assign the elevator cars car identifiers 1 through N, where 1 represents the target elevator car and 2 through N represent one or more other elevator car(s), N being the elevator car farthest from the target car.

At 414, the controller 58 calculates the desired profile needed for all N elevator cars in order to affect the change of profile for the target elevator car. The controller 58 then examines each elevator car, one by one, starting with the elevator car, N, farthest from the target elevator car. This is shown at 416, where a car identifier is set to N. Flow proceeds to 418 where the controller 58 determines, based on the profile for car N, whether there will be sufficient separation between the elevator cars (i.e., car N and its neighboring elevator car(s)). If sufficient separation cannot be assured, flow proceeds to 420 where the process to adjust the profile of the target elevator car is stopped. If at 418, the controller 58 determines there will be sufficient separation between car N and its neighboring elevator car(s), flow proceeds to 422 where the process of FIG. 4 is executed. If the motion controller 60 for elevator car N cannot accept the profile (FIG. 4, blocks 306 and 308), flow proceeds to 424 where the controller 58 makes a record of the failed verification and for future profile changes, the controller 58 assume worst case scenario. If any of the cars fail to completely confirm that the new profile has been accepted, the remaining sequence of profile modifications cannot be continued. This process keeps the elevator cars 62 operating with sufficient separation, but the attempt to modify the profiles of multiple elevator cars 62 must be re-evaluated or re-started (e.g., return to 410).

If the profile of car N is successfully updated at 422, flow proceeds to 426 where the controller determines if the car identifier is equal to 1 (i.e., the target elevator car has had its profile modified). If not, flow proceeds to 428 where the car identifier is reduced by one and flow proceeds to 418. If all the elevator cars have had updated profiles at 426, flow proceeds to 430 where the process is completed.

Embodiments provide for dynamically adjusting elevator car profiles in a multi-car elevator system. The use of dynamic motion profiles helps prevent situations in which passengers may be stopped in a car for no apparent reason due to obstructions from other elevator cars. An example of this may be to command a trailing elevator car to move at a low speed initially because of an obstruction by a leading elevator car, and increase the speed once the leading elevator car has cleared the following elevator cars intended destination.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A method for controlling car separation in a multi-car elevator system, the method comprising:

initiating, by a controller, a change in a profile of a target elevator car;

determining that N elevators cars are affected by the change in the profile of the target elevator car, wherein elevator car N is an elevator car farthest from the target elevator car;

calculating for each of the N elevator cars an updated profile;

for each of the N elevator cars, beginning with the Nth elevator car and ending with the target elevator car, performing:

determining if the updated profile for the elevator car will provide separation between the elevator car and a neighboring elevator car; and when the updated profile for the elevator car will provide separation between the elevator car and the neighboring elevator car, executing an elevator car profile update process for the elevator car.

2. The method of claim 1, wherein the elevator car profile update process comprises:

sending, from the controller to a motion controller, a target and a commanded profile for an elevator car;

receiving, at the motion controller, the target and the commanded profile, the motion controller determining an initial condition of the elevator car corresponding to a current condition of the elevator car;

generating, by the motion controller, a new profile for the elevator car in response to the target, the commanded profile and the initial condition of the elevator car; and sending from the motion controller to the controller an acceptance message indicating acceptance by the motion controller of the target and the commanded profile.

3. The method of claim 2 wherein the elevator car profile update process further comprises: sending, by the motion controller to the controller, the initial condition of the elevator car.

4. The method of claim 3 wherein the elevator car profile update process further comprises: determining, by the controller, an updated profile for the elevator car in response to the initial condition of the elevator car and the commanded profile.

5. The method of claim 2, wherein: the commanded profile includes a velocity limit, acceleration limit and jerk limit.

6. The method of claim 2, wherein: the initial condition of the elevator car includes position, velocity and acceleration.

7. The method of claim 2, wherein: the sending from the controller to the motion controller the target and the commanded profile for the elevator car includes sending a unique command identifier.

8. The method of claim 7, wherein: the sending from the motion controller to the controller the acceptance message includes sending the unique command identifier.

9. An elevator system comprising:

an elevator car;

a system to impart force to the elevator car in a hoistway;

a motion controller operable to command the system to impart force to the elevator car; and a controller in communication with the motion controller, the controller configured to execute operations comprising:

initiating a change in a profile of a target elevator car;

determining that N elevators cars are affected by the change in the profile of the target elevator car, wherein elevator car N is an elevator car farthest from the target elevator car;

calculating for each of the N elevator cars an updated profile;

for each of the N elevator cars, beginning with the Nth elevator car and ending with the target elevator car, performing:

determining if the updated profile for the elevator car will provide separation between the elevator car and a neighboring elevator car; and when the updated profile for the elevator car will provide separation between the elevator car and the neighboring elevator car, executing an elevator car profile update process for the elevator car.

10. The elevator system of claim 9 wherein the operations further comprise:

sending, from the controller to the motion controller, a target and a commanded profile for an elevator car;

receiving, at the motion controller, the target and the commanded profile, the motion controller determining an initial condition of the elevator car corresponding to a current condition of the elevator car;

generating, by the motion controller, a new profile for the elevator car in response to the target, the commanded profile and the initial condition of the elevator car; and sending from the motion controller to the controller an acceptance message indicating acceptance by the motion controller of the target and the commanded profile.

11. The elevator system of claim 10 wherein the operations further comprise:

sending, by the motion controller to the controller, the initial condition of the elevator car.

12. The elevator system of claim 11 wherein the operations further comprise:

determining, by the controller, an updated profile for the elevator car in response to the initial condition of the elevator car and the commanded profile.

13. The elevator system of claim 10, wherein: the commanded profile includes a velocity limit, acceleration limit and jerk limit.

14. The elevator system of claim 10, wherein: the initial condition of the elevator car includes position, velocity and acceleration.

15. The elevator system of claim 10, wherein: the sending, from the controller to the motion controller, the target and the commanded profile for the elevator car includes sending a unique command identifier.

16. The elevator system of claim 15, wherein: the sending from the motion controller to the controller the acceptance message includes sending the unique command identifier.

17. The elevator system of claim 9, wherein: the system to impart force to the elevator car is a ropeless system.

18. The elevator system of claim 9, wherein: the system to impart force to the elevator car is a roped system.

* * * * *